United States Patent [19]

Dickson

[11] Patent Number: 4,716,702

[45] Date of Patent: Jan. 5, 1988

[54] EDGE-TO-EDGE PANEL CONNECTION

[75] Inventor: J. Douglas Dickson, Columbus, Ohio

[73] Assignee: American Metal Door Company, Inc., Richmond, Ind.

[21] Appl. No.: 568,285

[22] Filed: Jan. 5, 1984

Related U.S. Application Data

[63] Continuation of Ser. No. 306,002, Sep. 28, 1987, abandoned.

[51] Int. Cl.[4] ..... E04C 1/30

[52] U.S. Cl. ..... 52/582; 52/772

[58] Field of Search ..... 52/582, 584, 586, 764, 52/779, 580, 772

[56] References Cited

U.S. PATENT DOCUMENTS

| | | | |
|---|---|---|---|
| 1,853,090 | 4/1932 | Smily, Jr. | 52/238.1 |
| 2,104,550 | 1/1938 | Bates | 52/582 |
| 2,128,797 | 8/1938 | Bohnsack | 52/481 |
| 2,137,767 | 11/1938 | Betcone | 52/62 |
| 2,414,628 | 1/1947 | Battin | 52/586 |
| 2,732,044 | 1/1956 | McClune | 52/580 |
| 3,001,613 | 9/1961 | McBerty | 52/580 |
| 3,072,227 | 1/1963 | Baker | 52/582 |
| 3,327,440 | 6/1967 | Watkins | 52/582 |
| 3,589,755 | 6/1971 | King | 52/582 |
| 3,683,576 | 8/1972 | Sikes | 52/580 |

FOREIGN PATENT DOCUMENTS

| | | | |
|---|---|---|---|
| 424164 | 5/1967 | Switzerland | 52/586 |

*Primary Examiner*—James L. Ridgill, Jr.
*Attorney, Agent, or Firm*—Barnes & Thornburg

[57] ABSTRACT

A system for connecting panels in adjacent edge-to-edge relationship comprises plates mounted to the edge of each panel providing a series of spaced-apart protuberances along each panel edge. Each protuberance includes an opening normal to the edges of the panels. A channel connector has a web which is interposed between the panel edges and includes a plurality of windows providing gateways through the web for the protuberances when the panels are placed in adjacent edge-to-edge relationship. Each window includes a downwardly extending tongue which is inserted into the opening corresponding to the protuberance in each window to interlock the two panels.

14 Claims, 3 Drawing Figures

EDGE-TO-EDGE PANEL CONNECTION

The present invention relates generally to systems for connecting two adjacent panels together to form an edge-to-edge panel connection, and more particularly to the use of such a system in the construction of fire doors of very large dimensions.

Various systems are well known for connecting panels to each other. Some of these systems are useful for connecting panels in right angular relationship, and some are useful for connecting panels in adjacent edge-to-edge relationship. Further, some of the conventional systems may be used for both types of panel connections. For example, U.S. Pat. Nos. 2,732,044; 3,001,613; 3,683,576; 3,589,755; 1,853,090; 3,072,227; and 3,327,440 disclose some of these conventional connection systems for panels. More particularly, each of these patents disclose a system for connecting panels in adjacent edge-to-edge relationship.

In constructing a fire door, it is important that the door provide a complete seal of a doorway when the door is closed in order to prevent fire or smoke from bypassing the door. Therefore, it has been standard practice to construct the door from a single panel in order to avoid the presence of any seams in the door. Further, standards for the construction of fire doors require that the doors be rigid and stiff for wind-load resistance. Because of these requirements, fire doors have heretofore been constructed using a single unitary panel. Transportation of large doors therefore presents a problem.

It is therefore an object of the present invention to be able to construct a fire door in various panel sections which could be individually transported and connected at the installation site to form the door. It is a further object of the present invention to construct a connection between the door panels which will satisfy the requirements and standards for fire door construction.

Another object of the present invention is to provide a system for connecting panels in adjacent edge-to-edge relationship which provides a rigid and concealed connection between the panels and which is further easy to assemble in the field.

Another object of the present invention is to provide an edge-to-edge panel connection system which provides a high degree of stiffness to the connection of those panels, provides a sealing connection between the panels, and which further eliminates the use of multiple fastener components in the field for connecting panels.

Yet another object of the present invention is to provide an edge-to-edge panel connection system which can quickly be used to assemble panels once the panels are placed in adjacent edge-to-edge relationship.

These and other objects of the present invention are satisfied by providing a system for connecting panels in adjacent edge-to-edge relationship which includes means providing a series of eyelets and openings alone each panel edge to be connected, the openings along each edge being spaced apart to receive the eyelets on the mating panel edge. An elongated channel member is then interposed between the panel edges for interlocking the eyelets on each panel edge, the channel member including a plurality of windows through which the eyelets of the adjacent panel edges project. Joined to the edge of each window is a tongue extending downwardly for insertion into the eyelets to prevent separation of the panels. The edge-to-edge panel connection thus formed may be viewed as having a pair of strips which provide a series of protuberances spaced apart along the edges of each panel, each protuberance including an aperture normal to the edge. A locking member interposed between the edges of the panels includes a series of windows through which the protuberances may project. Each window includes a gate which is movable into engagement with the aperture of the protuberance projecting through that window, thereby interlocking the adjacent panels.

Preferably, the edge of each panel to be connected fits into the bight of a U-shaped strip fixed continuously along the edge of the panel with the outer surfaces of the panels extending over and engaging the sides of the strips. The U-shaped strip includes a plurality of spaced-apart tabs projecting away from the panel to which the strip is fixed. An H-shaped beam having a plurality of apertures in its web is situated between two such adjacent panels, the tabs of each panel projecting through the apertures in the web of the H-shaped beam. A tongue defined by the perimeter of the apertures in the web of the beam and lying in the plane of the linear plate forming the web lockingly engages a contact surface of each tab to prevent separation of adjacent panels. The sides of the H-shaped beam completely encompass the connection and present a substantially continuous surface with the adjacent panels.

An advantage of the present invention is that a rigid concealed connection is created between adjacent panels positioned in edge-to-edge relationship. While the features of the present invention can be employed in many environments, a particular advantage is enjoyed in constructing a very large dimension fire door in that individual sections may be easily transported to the installation site prior to construction into the final product. The on-site construction is simplified greatly by the present invention, since no multi-element fastener components are needed to be employed in the field for connecting the panels together.

Other features and advantages of the present invention will become apparent in view of the following detailed description of one embodiment thereof exemplifying the best mode of carrying out the invention as presently perceived, which description should be considered in conjunction with the accompanying drawings in which.

Although the present invention will be described in relation to metal fire door structures which are installed in buildings to close and seal a section of the building in the event of a fire in such section, an edge-to-edge panel connection embodying the present invention may also be used in various other applications. Therefore, it is not intended that the edge-to-edge panel connection of the present invention be necessarily limited to a metal fire door structure.

Figure 2:
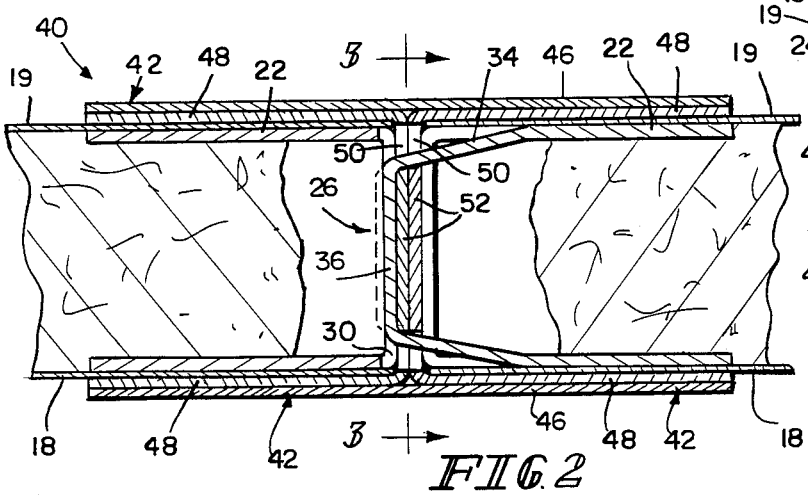
FIG. 2 is a cross-sectional view of the edge-to-edge panel connection shown in FIG. 1 taken generally along section lines 2—2 of FIG. 1.

Referring to the figures, panels 10 and 14 include vertical edges 12 and 14, respectively, which, in an edge-to-edge connection of the panels 10 and 14, are abutted so that the corresponding surfaces 18 and 19 of the panels 10 and 14 are in the same relative plane. In a fire door structure, panels 10 and 14 are typically constructed of a thermal insulating core material and metal external surfaces 18 and 19. Other types of core material may be used in other door structures. The panels 10 and 14 may also include a perimetral frame of rigid steel tubing (not shown). In constructing large fire doors, panels 10 and 14 are fabricated and shipped to the installation site where they are connected by the edge-to-edge connection system of the present invention to assemble the completed fire door structure. An edge-to-edge connection system embodying the present invention includes vertical edge members 20 which are generally U-shaped in cross section and are connected to the abutting vertical edges 12 and 16 of the panels 10 and 14, respectively. Each vertical edge member 20 includes side sections 22 which engage the surfaces 18 and 19 of the panels 10 and 14. Each vertical edge member 20 also includes a vertical plate section 24 which engages and extends along the vertical edge 12 and 16 of the panels 10 and 14, respectively. Preferably, the edge 12, 16 of each panel 10, 14 fits into the bight of a vertical edge member 20 so that the outer surfaces 18 and 19 extend over and conceal the side sections 22, as best shown in FIG. 2. The outer surfaces 18 and 19 and side sections 22 are then spot-welded to each other to provide a connection therebetween.

The vertical plate section 24 of each vertical edge member 20 includes an alternating series of spaced-apart protuberances 26 and openings 30. The distance between each successive protuberance 26 and opening 30 is generally the same. This alternating series of protuberances 26 and openings 30 can best be seen in FIG. 1.

Figure 3:
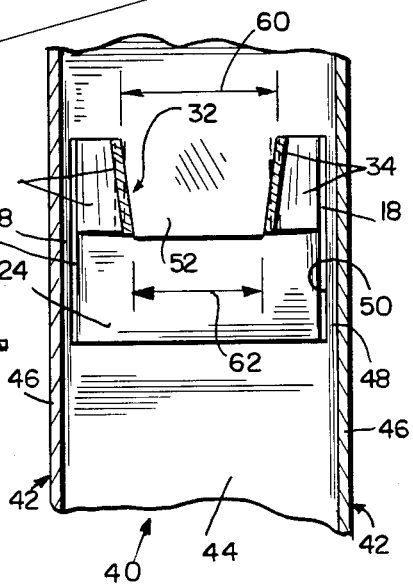
FIG. 3 is a side elevational view with portions broken away lf the edge-to-edge panel connection shown in FIG. 1.

Referring more particularly to FIG. 2, each protuberance 26 includes a generally trapezoidal-shaped aperture 32 which is formed by two angular side sections 34 and an end section 36. The protuberances 26 project outwardly at a generally right angle to the vertical edges 12 and 16 of the panels 10 and 14, respectively, so that the aperture 32 is generally normal to the vertical edges 12 and 16. As can best be seen in FIG. 3, the alternating relationship of the protuberances 26 and the openings 30 on the vertical edge 12 of one of the panels 10 is generally opposite to the alternating relationship of the protuberances 26 and the openings 30 on the vertical edge 16 of the other panel 14 so that when the edges 12 and 16 are abutted, protuberances along the vertical edge 12 of panel 10 are received in the openings 30 along the vertical edge 16 of panel 14, and protuberances 26 along the vertical edge 16 of panel 14 are received in the openings 30 along the vertical edge 12 of panel 10. In abutting edge-to-edge relationship, the openings 32 of all of the proturberances 26 are vertically aligned between the edges 12 and 16.

The vertical edges 12 and 16 are interlocked by a vertical locking member 40 which is generally H-shaped in cross section. The H-shaped locking member includes two opposed side sections 42 and a web section 44 therebetween. The side sections 42 and web section 44 are constructed from two vertical panels 46 which form the outer surface of the side sections 42 and two generally U-shaped vertical channels 48 which are connected to each other and to the vertical panels by conventional means such as welding. The two U-shaped vertical channel members form elongated vertical channels 49 which open outwardly in opposed directions for receiving the vertical edges 12 and 16 of panels 10 and 14, respectively.

Figure 1:
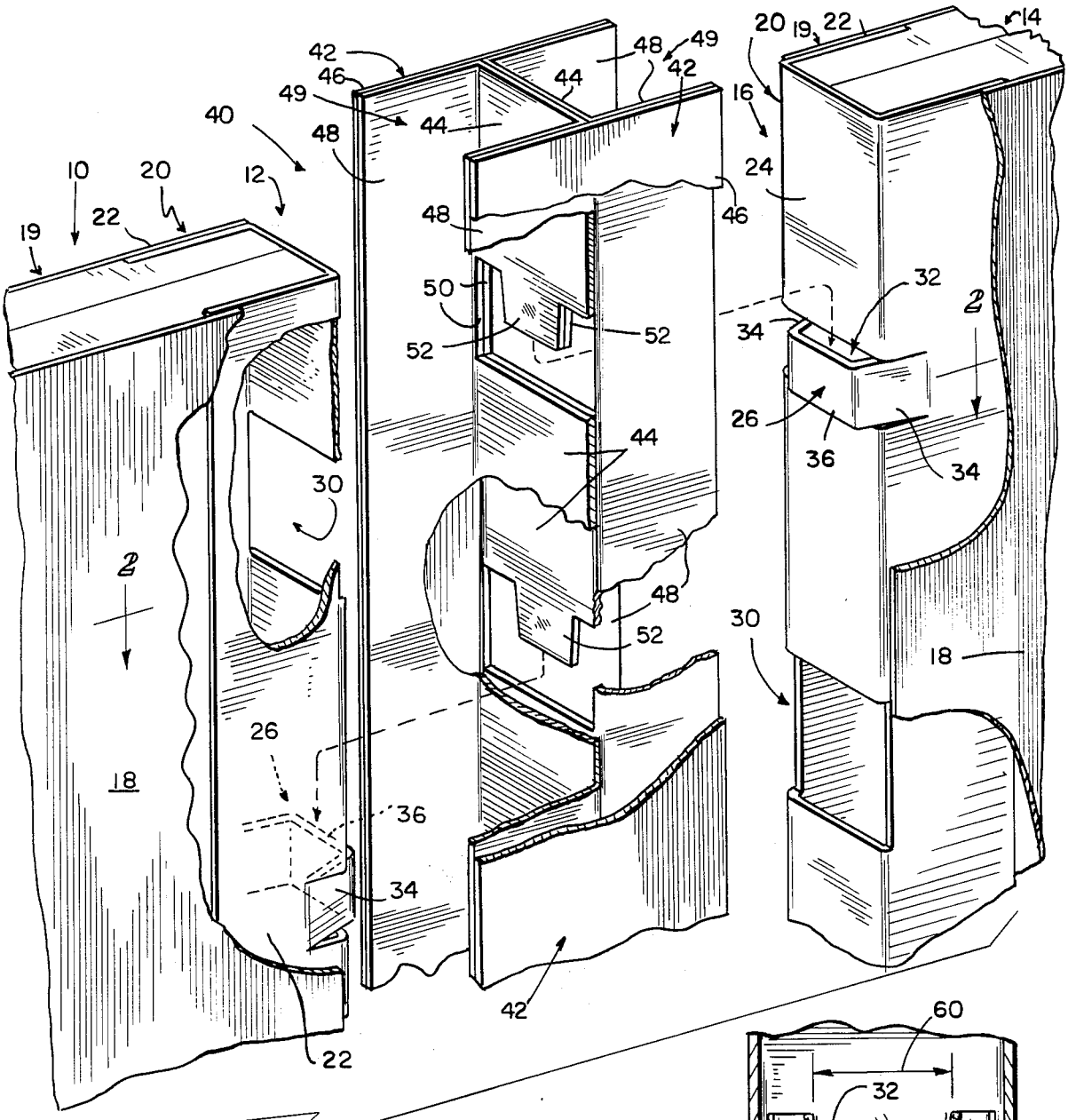
FIG. 1 is an exploded perspective view with portions broken away of an edge-to-edge panel connection embodying the present invention.

Referring particularly to FIG. 1, the web section 44 of the locking member 40 includes a series of spaced-apart windows 50. The distance between each of the windows 50 corresponds generally to the distance between the protuberances 26 and openings 30 along the vertical edge members 20. Windows 50 provide a gateway for allowing passage of the protuberances through the web portion of the locking member 40. Each window 50 includes a downwardly extending tongue or gate member 52 having a generally trapezoidal shape. Each of the tongues 52 is inserted into an aperture 32 formed by the protuberances 26 to interlock the panels 10 and 14. It should be noted that the tongues 52 have a maximum dimension 60 and minimum dimension 62. Apertures 32 in the protuberances 26 have a length which is slightly less than the maximum dimension 60 of the tongues 52 to provide a tight wedge-like connection between the tongues 52 and apertures 32.

Operation of the edge-to-edge connection system to the present invention can best be described by referring to all of the figures in combination. The panels 10 and 14 are initially placed in adjacent edge-to-edge relationship with vertical edge 12 facing vertical edge 16. Locking member 40 is placed between the vertical edges 12 and 16 before they are butted together. Locking member 40 is raised slightly upwardly so that the tongues or gate members 52 in the web section 44 of the locking member 40 allow the protuberances 26 along each vertical edge member 20 to pass through the windows 50 in the web section 44. As the protuberances 26 are passed through the windows 50, the edges 12 and 16 of the panels 10 and 14, respectively, extend into the open channels 49 of the locking member 40 so that the side sections 42 engage the surfaces 18 and 19 of the panels 10 and 14. Once the protuberances have been inserted through the windows 50 so that they engage corresponding openings 30 in the opposite vertical edge member 20, the locking member 40 is driven downward to force the tongues or gate members 52 into the apertures 32 formed in the protuberances 26. This interlocking relationship can best be seen in FIG. 2. Because of the slight difference between the maximum dimension 60 of the tongues 52 and the length of the apertures 32, the protuberances 26 are slightly deformed when the locking member 40 is driven, as shown by the downward dotted lines in FIG. 2, so that the tongues 52 can be forced into engagement with the apertures 32.

The two panels 10 and 14 are securely and rigidly connected by the interlocking of the protuberances 26 along each vertical edge member 20 and the tongues or gate members 52 in the web section 44 of the locking member 40. Further, the side sections 42 of the locking member 40 provide smooth surfaces on either side of the connection which blend with the surfaces 18 and 19 of the panels 10 and 14 and conceal the connection between the two panels 10 and 14. Further, the side sections 42 in cooperation with the surfaces 18 and 19 provide a seal along the connection between the two panels 10 and 14.

What is claimed is:

1. An edge-to-edge panel connection comprising two panels having abutting edges in adjacent edge-to-edge relationship, means providing a series of protuberances spaced apart along the edges of the panels, each protuberance including an aperture normal to the edges, and locking means movable between the edges for engaging the apertures to interlock the panels, the locking means including two side sections and a web section therebetween forming two channels opening outwardly to receive the edges of the panels, and a series of windows in the web section providing gateways for the protuberances, each window including a gate movable into engagement with the aperture of the protuberance received in the gateway.

2. The connection of claim 1 wherein the locking means is generally an H-shaped beam.

3. The connection of claim 2 wherein the gates are fixed in the windows and include tongues extending at least partially into the gateways, the tongues being movable simultaneously in response to movement of the beam to engage the apertures in the protuberances.

4. The connection of claim 3 wherein the means providing the series of protuberances includes a series of openings spaced apart along the edges, the openings along each edge being provided in positions corresponding to the positions of protuberances along the other edge.

5. A system for connecting panels in adjacent edge-to-edge relationship comprising means providing a series of eyelets and openings along each panel edge, the openings along each edge being spaced apart to receive the eyelets on the other panel edge, and an elongated channel member having two channels for receiving the edges of the panels, the channel member being movable between the panel edges to interlock the eyelets on each panel edge, the channel member including a plurality of windows providing gateways through the channel member for receiving the eyelets and tongue means extending downwardly in each window for insertion into the eyelets when the channel member is moved to prevent separation of the panels.

6. The system of claim 5 wherein the channel member is generally H-shaped in cross section and includes side portions which are interconnected by a web portion, the web portion include the plurality of windows and the side portions engage panel surfaces to conceal the connection of the panel edges.

7. A connection for connecting an edge of a first panel to an adjacent edge of a second panel, the connection comprising:

a pair of substantially continuous U-shaped strips, each strip fixed along an edge of the panel to be connected, each strip comprising a plurality of spaced-apart tabs projecting from its bight away from the panel edge to which the strip is fixed, each tab having a contact surface facing the panel edge from which the tab projects, and a locking means movable between the pair of strips for locking together the panels having the strips fixed thereto, the locking means comprising an H-shaped beam having a web, the web forming a linear plate having a plurality of apertures therethrough, means in each aperture providing a perimeter projecting into contacting engagement with said contact surface of each tab when the H-shaped beam is moved to interlock the panels.

8. The connection of claim 7 wherein each U-shaped strip further comprises a plurality of openings on the bight of the strip, an opening being situated between each adjacent pair of tabs projecting from the strip for receiving at least part of the tabs of an adjacent strip.

9. The connection of claim 7 wherein said tabs each comprise U-shaped projections projecting from the bight of the U-shaped strips, and the perimeter of said apertures defines a tongue in the plane of said linear plate, each tongue being received behind one of said U-shaped projections.

10. The connection of claim 7 wherein the H-shaped beam has legs which are approximately the same length as the legs of the U-shaped strips, the sides of the beam thereby encompassing the entire connection.

11. A connection for connecting an edge of a first panel to an adjacent edge of a second panel, the connection comprising a pair of substantially continuous strips, each strip fixed along an edge of one of the panels to be connected, each strip including a plurality of spaced-apart protuberances projecting away from the panel edge to which the strip is fixed, each protuberance having a first contact surface facing toward the panel edge to which the strip is fixed, and locking means movable between the pair of strips for locking together the panels having the strips fixed thereto, the locking means including an H-shaped member having a web, the web forming a linear plate including a plurality of apertures, means in each aperture providing a second contact surface for engagement with the first contact surface of a protuberance when the H-shaped member is moved to prevent separation of the panel edges.

12. The connection of claim 11 wherein at least one of the first and second contact surfaces includes a tongue and the other of the first and second contact surfaces includes an eyelet for receiving the tongue.

13. The connection of claim 12 wherein the tongue is generally trapezoidal-shaped and the eyelet is generally trapezoidal-shaped to provide a wedge connection therebetween.

14. A connection for connecting an edge of a first panel to an adjacent edge of a second panel, the connection comprising a pair of substantially continuous strips, each strip fixed along an edge of one of the panels to be connected, each strip including a plurality of spaced-apart tabs projecting away from the panel edge to which the strip is fixed, each tab incluing an aperture providing a first contact surface facing toward the panel edge to which the strip is fixed, and locking means movable between the pair of strips for locking together the panels having the strips fixed thereto, the locking means including an H-shaped member, the H-shaped member including a linear plate having a plurality of windows for receiving the tabs, each window including a spline projecting into contacting engagement with the contact surface of an aperture when the H-shaped member is moved, the splines and apertures being trapezoidal-shaped to form a wedge connection therebetween to prevent separation of the panels.

* * * * *

UNITED STATES PATENT AND TRADEMARK OFFICE

CERTIFICATE OF CORRECTION

PATENT NO. : 4,716,702

DATED : January 5, 1988

INVENTOR(S) : J. Douglas Dickson

It is certified that error appears in the above-identified patent and that said Letters Patent is hereby corrected as shown below:

On the cover page, in the section entitled "Related U.S. Application Data", "September 28, 1987" should be changed to --September 28, 1981--.

Signed and Sealed this

Thirtieth Day of August, 1988

*Attest:*

*Attesting Officer*

DONALD J. QUIGG

*Commissioner of Patents and Trademarks*